United States Patent [19]

Tsutsui et al.

[11] 4,150,916

[45] Apr. 24, 1979

[54] AXIAL FLOW INDUCERS FOR HYDRAULIC DEVICES

[75] Inventors: Toshiaki Tsutsui; Akira Oyamada; Tomomitsu Hamaguchi; Akihiko Agata, all of Tokyo, Japan

[73] Assignee: Nikkiso Co., Ltd., Tokyo, Japan

[21] Appl. No.: 780,041

[22] Filed: Mar. 22, 1977

Related U.S. Application Data

[62] Division of Ser. No. 606,467, Aug. 21, 1975, abandoned.

[30] Foreign Application Priority Data

Mar. 13, 1975 [JP] Japan ..... 50-30587
Mar. 13, 1975 [JP] Japan ..... 50-30588
Mar. 13, 1975 [JP] Japan ..... 50-30589

[51] Int. Cl.[2] ..... F04D 13/12; F04D 17/14

[52] U.S. Cl. ..... 415/143; 415/199.6

[58] Field of Search ..... 415/74, 143, 198.1, 415/213 R, 199.6; 416/175, 176, 177, 189, 192

[56] References Cited

U.S. PATENT DOCUMENTS

| | | | |
|---|---|---|---|
| 2,984,189 | 5/1961 | Jekat | 415/143 |
| 3,200,754 | 8/1965 | Burgin | 415/143 |
| 3,384,022 | 5/1968 | Oshima | 415/198 |
| 3,918,831 | 11/1975 | Grennan | 415/143 |

*Primary Examiner*—Louis J. Casaregola

[57] ABSTRACT

An axial flow inducer for hydraulic devices is disclosed. The inducer is coaxially arranged in front of a fluid suction inlet side of a main impeller of an hydraulic device, for example, a pump and constituted by at least two axial flow blade parts which are constructed and arranged so as to prevent an occurrence of noise over all flow amount region of the impeller.

7 Claims, 7 Drawing Figures

AXIAL FLOW INDUCERS FOR HYDRAULIC DEVICES

This is a divisional application of Ser. No. 606,467, filed Aug. 21, 1975 abandoned.

This invention relates to pump inducers and more particularly to an axial flow inducer coaxially arranged upstream an impeller of the pump and adapted for use in a hydraulic device such as a centrifugal pump and the like.

In a hydraulic device such as a pump and the like, it has been the common practice to use an axial flow inducer for the purpose of significantly improving the fluid sucking characteristic of the hydraulic device.

The axial flow inducer of this kind, however, has the disadvantage that an intense puslating noise occurs in a pump suction pipe over its small range of flow rates due to the restricted delivery condition.

In addition, this pulsation becomes increased as the suction pressure of the pump is decreased until a sort of water hammer occurs in the pump suction pipe. As a result, there is a risk of the suction pipe being broken down.

The inventors have recognized by their enthusiastic study and experiments that, over the small range to flow rates of the pump, the pulsations occur in the suction pipe owing to the fact that the design flow rate of the inducer is set for a value which is about three times larger than that of a main impeller, and as a result, a fluid counter flow becomes considerably increased at that inducer part of the pump which corresponds to the small range of flow rates.

In order to overcome such difficulty, the inventors have recognized by their further study and experiments that if the design flow rate of the inducer is set for a value which is within a range of 1.0 to 2 times the design flow rate of the main impeller, the suction stroke of the inducer can be improved. In this case, even when the flow rate slightly exceeds the design flow rate and hence the inducer stroke becomes somewhat decreased, an occurrence of the fluid counter flow, that is, an occurrence of cavitation can be made extremely small.

An object of the invention, therefore, is to provide an axial flow inducer which can prevent an occurrence of noise over all flow rates of the main impeller.

An aspect of the invention is to provide an axial flow inducer coaxially arranged in front of a main impeller and having a design flow rate which is about 1.0 to 2 times the design flow amount of the main impeller.

The inventors have found out by their study and experiments that if an axial flow blade is constituted by at least two axial flow blade parts and provision is made for a sleeve having one end secured to the outer peripheral edge of that axial flow blade part which is located near the fluid inlet end of the inducer and having another end extending toward the fluid inlet side and bent inwardly so as to form a barrier, the fluid counter flow produced at the main impeller of a hydraulic device, for example, a pump and the like can be confined into a local counter flow between the main impeller and an axial flow blade part adjacent thereto and also the fluid counter flow produced in front of the front axial blade part can be confined into a space formed by the sleeve which is rotated together with the inducer. As a result, it is possible to prevent the fluid pulsation and hence the noise from being produced in the suction pipe over all flow rates of the main impeller irrespective of the design flow amount of the inducer.

Another object of the invention, therefore, is to provide an axial flow inducer which can confine the fluid counter flow produced at the suction side of the main impeller into a local counter flow so as to prevent an occurrence of noise over all flow rates of the main impeller.

Another aspect of the invention is to provide an axial flow inducer coaxially arranged in front of a main impeller, comprising a sleeve having one end secured to the outer peripheral edge of the inducer and another end bent inwardly so as to form a barrier.

In addition, the inventors have found out by their study and experiments that the following measures can obviate the difficulty of significant increases in the fluid counter flow produced at the inducer part over a range of low flow rates. That is, if provision is made of at least two stages of axial flow blades including a front stage axial flow blade part and a rear stage axial flow blade part connected in cascade and having blade angles different from one stage to the other stage, the blade angle of the front stage axial flow blade part located at the fluid suction inlet side being made considerably smaller so as to make the rear stage axial flow blade part larger in the blade angle than the front stage axial flow blade part, if the rear stage axial flow blade part is separated from the front stage axial flow blade part by a suitable distance, and if the outer diameter of the rear stage axial flow blade part is made smaller than that of the front stage axial flow blade part by a suitable dimension, when a portion of the fluid introduced from the front stage axial flow blade part into a pump chamber inlet causes a fluid counter flow, the rear stage axial flow blade part can easily suck the fluid counter flow and can make it circulate again and the front stage axial flow blade part serves as a barrier to suppress the fluid counter flow from entering into the pump suction pipe, thereby preventing a fluid pulsation in the pump suction pipe and hence reliably preventing an occurrence of noise during operation of the pump.

A further object of the invention, therefore, is to provide an improved axial flow inducer which can confine a fluid counter flow produced at the suction side of the main impeller into a local fluid counter flow and hence which can prevent an occurrence of noise over all fluid flow rates.

A further feature of the invention is the provision of an axial flow inducer comprising at least two stages of axial flow blades including a front stage axial flow blade part located at the fluid inlet side and a rear stage axial flow blade part, the blade angle of the front stage axial flow blade part being made smaller than that of the rear stage axial flow blade part so as to cause a fluid counter flow produced by a rotation of a main impeller of a hydraulic device to be sucked by the rear stage axial flow blade part.

Making the blade angle of the front stage axial flow blade part considerably smaller causes a fluid counter flow in front of the front stage axial flow blade part and hence generates a noise.

The inventors have found out that if provision is made for a barrier in front of the front stage axial flow blade part by a suitable means, it is also possible to accelerate a re-circulation of the fluid counter flow and operate the main impeller without producing any noise over any range of flow rates.

A still further feature of the invention, therefore, is the provision of an axial flow inducer comprising further a barrier provided in front of the front stage axial flow blade part.

Other objects and advantages of the present invention will become apparent as the detailed description thereof proceeds.

The invention will now be described in greater detail with reference to the accompanying drawings, wherein.

Figure 1:
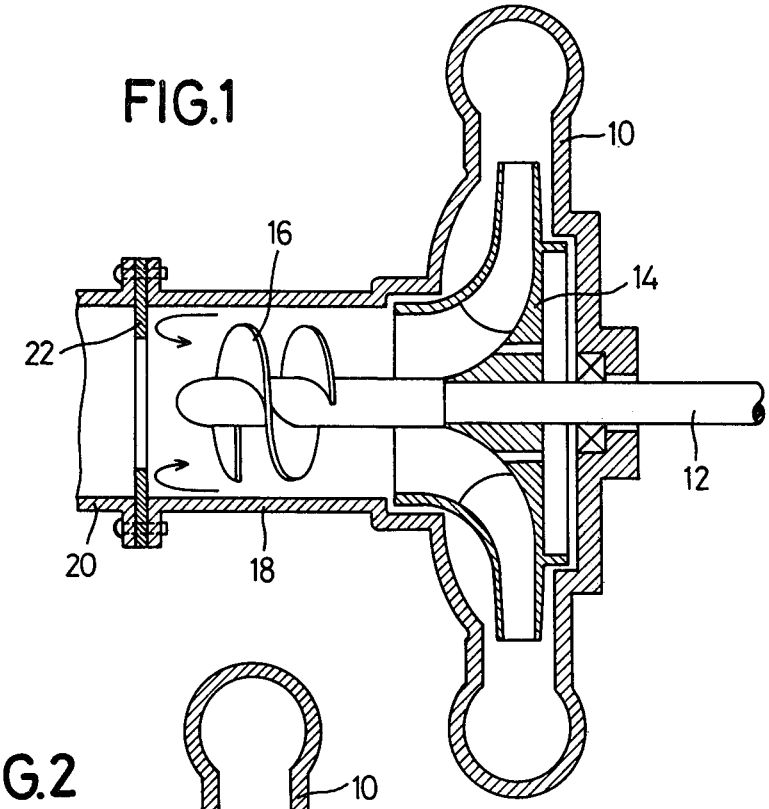
FIG. 1 is a longitudinal sectional view of one embodiment of an axial flow inducer according to the invention applied to a pump.

Referring to FIG. 1, reference numeral 10 designates a pump casing in which is arranged a main impeller 14 secured to a rotary shaft 12 rotatably journaled by the pump casing 10. In front of a fluid suction inlet side of the main impeller 14 is coaxially arranged an inducer 16.

In the invention, the inducer 16 is constructed such that its design flow amount is about 1.0 to 2 times the design flow amount of the main impeller 14.

The design flow amount of the inducer 16 thus defined makes it possible to prevent an occurrence of fluid counter flow in the pump suction inlet part where the inducer is located when the pump is operated in a manner such that the pump flow amount is somewhat larger than the design flow amount of the inducer, thereby preventing an occurrence of cavity.

In the present embodiment, a barrier plate 22 is sandwiched between a pump suction inlet part 18 of the pump casing 10 and the suction pipe 20. The barrier plate 22 serves to effectively prevent the fluid counter flow produced along the inside wall surface of the pump inlet part 18 from reaching into the suction pipe 20, thereby preventing a noise followed by the fluid counter flow.

Figure 2:
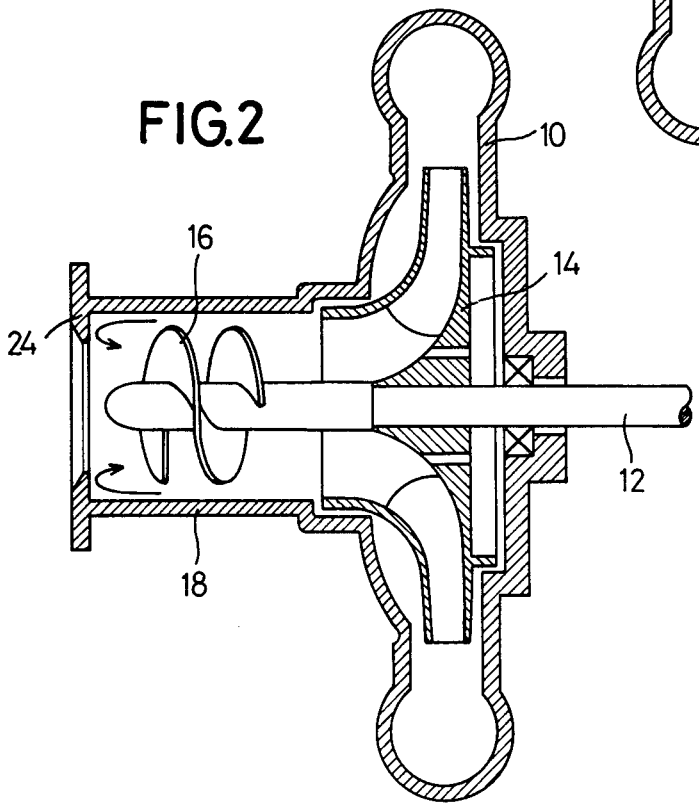
FIG. 2 is a longitudinal sectional view of another embodiment of the axial flow inducer according to the invention.

In FIG. 2 is shown another embodiment of the invention. In the present invention, the pump suction inlet part 18 of the pump casing 10 is provided at its front end with a flange-like barrier 24. The present embodiment is capable of preventing the noise caused by the fluid counter flow in the same manner as in the previous embodiment.

As stated hereinbefore, by setting the design flow rate of the inducer at a value which is 1.0 to 2 times the design flow rate of the main impeller, the occurrence of noise can reliably be prevented over any range of flow rates of the main impeller.

Figure 3:
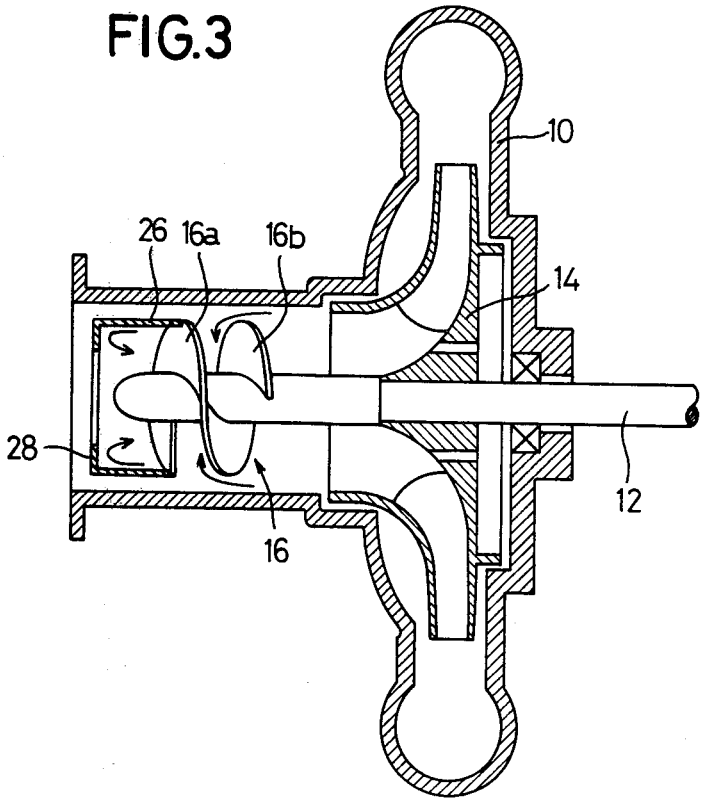
FIGS. 3 to 7 are longitudinal sectional views of further embodiments of the axial flow inducer according to the invention, respectively.

In FIG. 3 is shown a further embodiment of the invention. In the present invention, provision is made of a sleeve 26 having one end secured to the outer peripheral edge of a front axial flow blade part **16*a* and another end bent inwardly so as to form a barrier 28**.

The provision of the cylindrical barrier 28 located in front of the suction side of the inducer 16 and secured to the suction side of the inducer 16 makes it possible to cause the fluid counter flow produced at the side of the main impeller 14 to circulate again along a rear axial flow blade part **16*b* and hence confine the fluid counter flow into a local fluid counter flow and also possible to cause the fluid counter flow produced near the front axial flow blade part 16*a* to circulate again in the sleeve 26 by the action of the barrier 23 provided for the sleeve 26**.

The use of the measure described above provides the important advantage that the fluid counter flow produced at the inducer 16 is reliably prevented from being delivered into the fluid suction pipe, so that the noise caused by the fluid counter flow can completely be prevented over any range of flow rates during the operation of the pump.

That is, the sleeve 26 provided in front of the inducer 16 and having the barrier 28 is rotated together with the inducer 16, so that the fluid counter flow produced in front of the inducer 16 is prevented from producing a secondary flow. In addition, the fluid introduced into the inducer 16 is subjected to the action of the sleeve 26 provided for the outer periphery edge of the inducer 16 to effect a forced re-circulation of the fluid counter flow within a region in which the inducer 16 is located, thereby reliably preventing the pulsation of the fluid in the suction pipe of the pump.

The present embodiment is simple in construction and easy in manufacture and can be applied to hydraulic devices such as pumps having various kinds of capacity irrespective of the design flow amount of the inducer.

Figure 4:
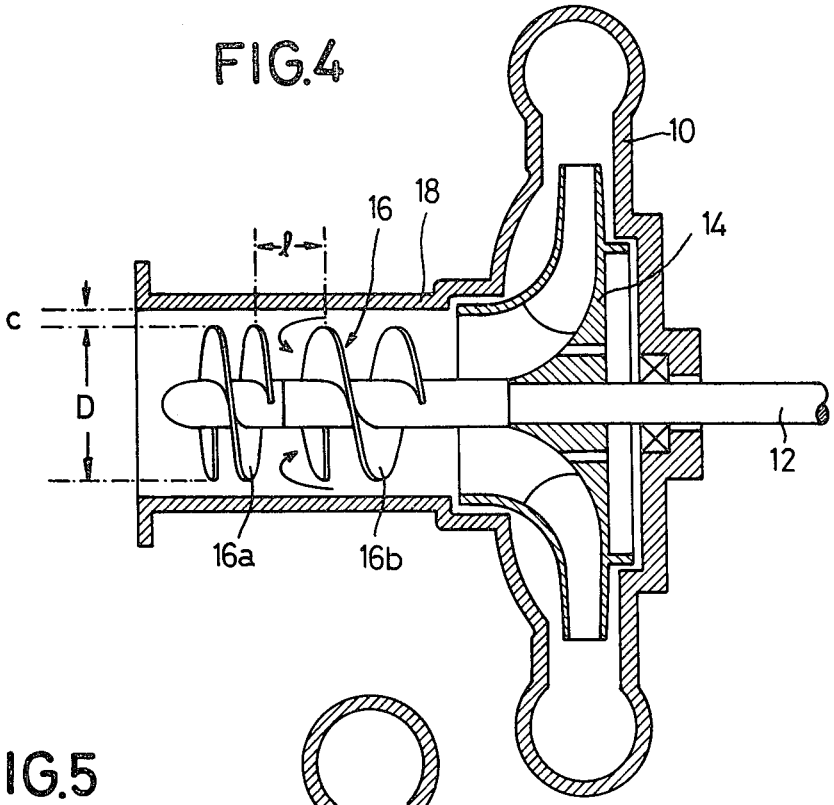

In FIG. 4 is shown a still further embodiment of the invention. In the present embodiment, the inducer 16 is constituted by at least two stages of axial flow blade parts including, for example, a front stage axial flow blade part **16*a* and a rear stage axial flow blade part 16*b*** which are different in blade angles from each other.

The blade angle of the front stage axial flow blade part **16*a* located at the fluid suction inlet side is made extremely small while the blade angle of the rear stage axial flow blade part 16*b* is made large. In this case, it is preferable to define a gap C between the outer peripheral edge of the front stage axial flow blade part 16*a*** and the inside wall surface of the inlet of the pump chamber as small as possible.

In addition, an axial distance 1 between the front stage axial flow blade part **16*a* and the rear stage axial flow blade part 16*b* is made equal to 0.05 to 0.15 times smaller than a diameter D of the axial flow blade of the inducer 16**.

In order to easily define the axial distance 1, the front stage axial flow blade part **16*a* is made separate from the rear stage axial flow blade part 16*b*** and detachably connected to the latter.

If the fluid introduced from the front stage axial flow blade part **16*a* into the pump chamber inlet produces a fluid counter flow between the rear stage axial flow blade 16*b* and the main impeller 14, the present embodiment makes it possible to easily suck the fluid counter flow into a space formed between the front stage axial flow blade part 16*a* and the rear stage axial flow blade part 16*b*** and effect a re-circulation of the fluid. As a result, a noise caused by the fluid counter flow extended over a wide region can effectively be prevented.

Figure 5:
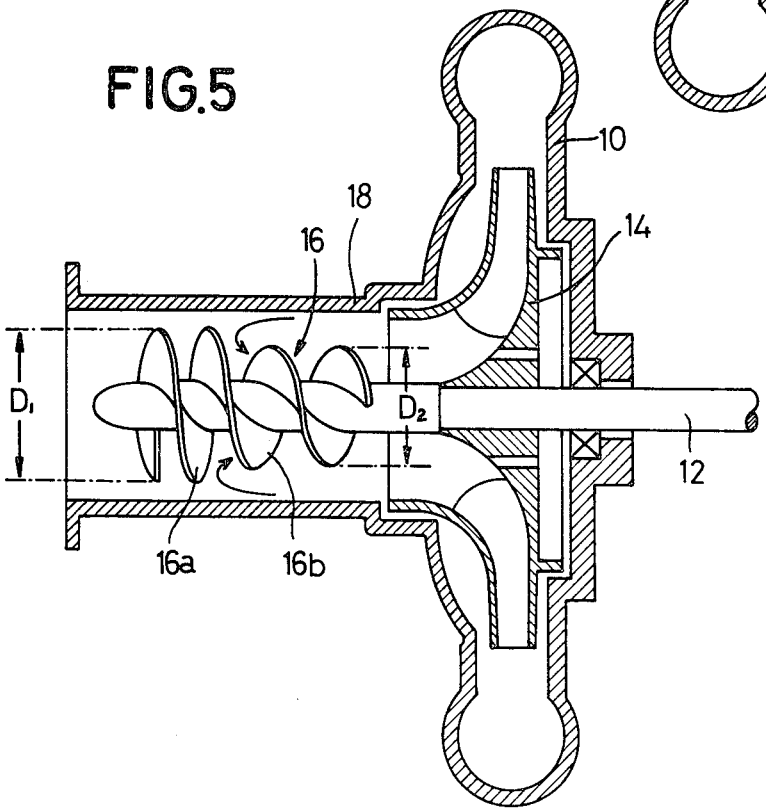

In FIG. 5 is shown another embodiment of the invention. In the present embodiment, the outer diameter $D_2$ of the rear stage axial flow blade part **16*b* is made smaller than the outer diameter $D_1$ of the front stage axial flow blade part 16*a* for this purpose of easily sucking the fluid counter flow produced at the pump chamber inlet into a space formed between the front stage axial flow blade part 16*a* and the rear stage axial flow blade part 16*b***. The present embodiment can prevent the noise in the same manner as in the case of the previous embodiments.

In the present embodiment, the front stage axial flow blade part 16a may be made integral with the rear stage axial flow blade part 16b. In addition, it is most preferable to define a difference between the outer diameter $D_1$ of the front stage axial flow blade part 16a and the outer diameter $D_2$ of the rear stage axial flow blade part 16b by a formula given by $D_1-D_2=(0.03 \text{ to } 0.1)D_1$.

In the present embodiment, the fluid which has been introduced into the inducer 16 causes the fluid counter flow to re-circulate in the space formed between the front stage axial flow blade part 16a and the rear stage axial flow blade part 16b, thereby confining the fluid counter flow into a local fluid counter flow.

But, the above mentioned measure could not suppress a fluid counter flow produced in front of the front stage axial flow blade part.

In the invention, in order to suppress such counter flow, provision is made of a barrier in front of the front stage axial flow blade part 16a.

Figure 6:
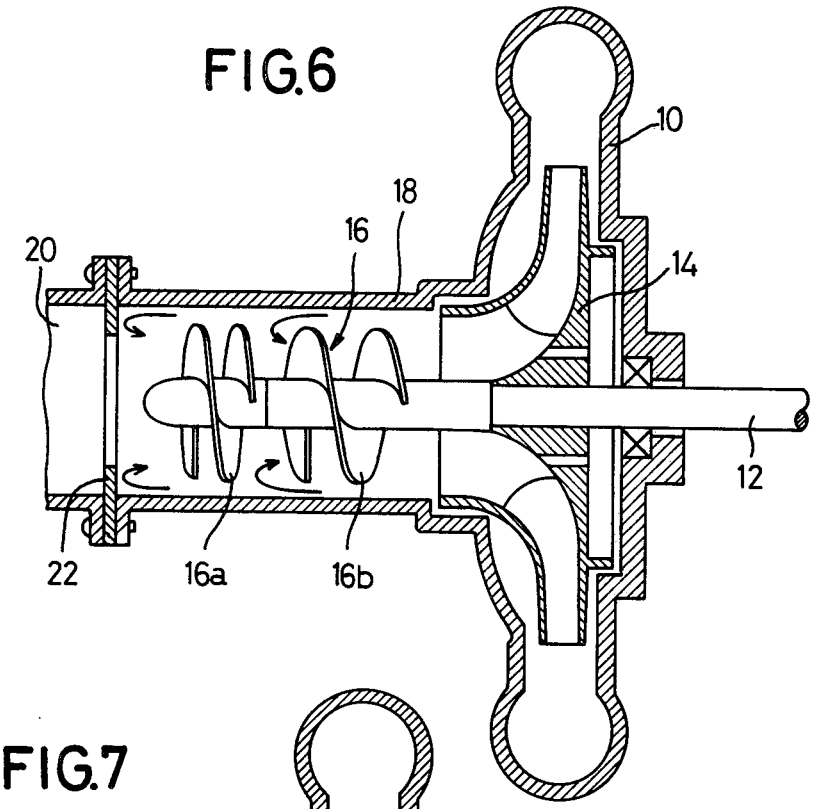

In FIG. 6 is shown one embodiment of providing such a barrier. In the present embodiment, a barrier plate 22 is sandwiched between the pump suction inlet part 18 of the pump casing 10 and the suction pipe 20. The present embodiment provides a way of simply arranging the barrier plate.

Figure 7:
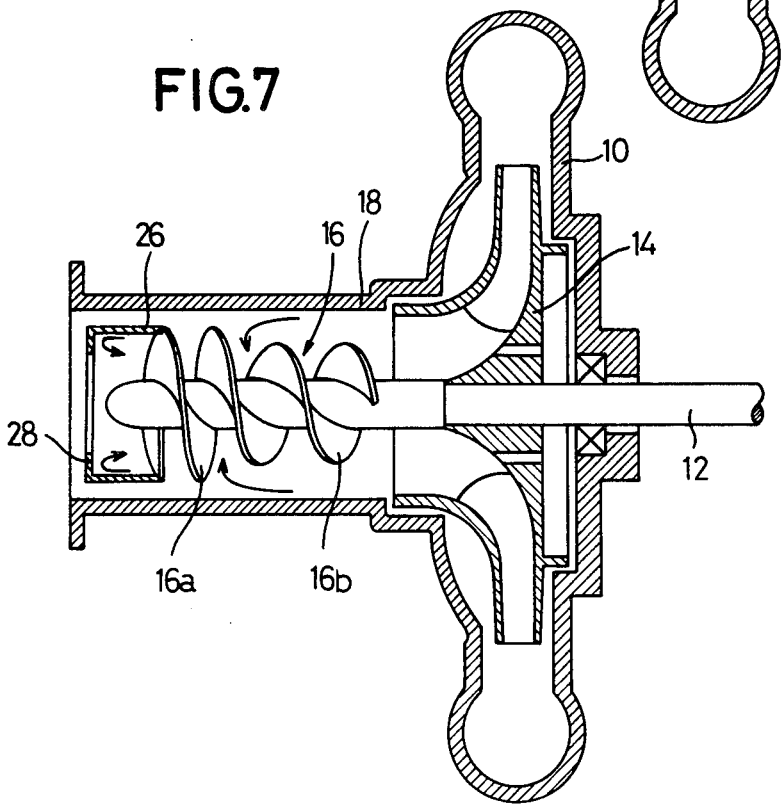

In FIG. 7 is shown another embodiment of providing the barrier. In the present embodiment, the front stage axial flow blade part 16a is provided at its outer peripheral edge with a sleeve 26 having one end secured thereto. The sleeve 26 is extended along a fluid inflow direction, another end of the sleeve 26 being bent inwardly so as to form a barrier 28.

In the present embodiment, the wall part of the sleeve 26 which forms the barrier 28 is rotated together with the inducer 16, so that it is possible to effectively suppress the fluid counter flow by the inside space of the sleeve 24.

As stated hereinbefore, the axial flow inducer according to the invention is capable of confining all modes of fluid counter flow produced at the inducer part into respective local counter streams, and of preventing the fluid counter flow from being spread over the entire range of flow rates thereby operating the pump without noise in smooth manner.

The axial flow inducer according to the invention has such advantages that it is simple in construction, and that it can be easily and cheaply manufactured in a mass production scale.

Of course, the invention is not limited to the above examples as described and represented. From these examples other modes and forms of realization can be foreseen without departing from the spirit of the invention.

What is claimed is:

1. An axial flow inducer for hydraulic devices comprising a pump casing, a rotary shaft rotatably journaled by said pump casing, a main impeller secured to said rotary shaft, and an inducer having axial flow blades coaxially arranged in front of a fluid suction inlet side of said main impeller a sleeve extending forwardly of the front of said inducer and having one end secured to the outer peripheral edge of said inducer and the opposite end bent inwardly and spaced from the front of said inducer so as to form a barrier, said axial flow blades being constructed and arranged so as to prevent an occurrence of noise over the region of said impeller.

2. An axial flow inducer for hydraulic devices as claimed in claim 1, wherein a design flow amount of said inducer is about 1.0 to 2 times the design flow amount of said main impeller.

3. An axial flow inducer for hydraulic devices according to claim 1, wherein said barrier is annular and forms a hole concentric with the axis of the rotary shaft.

4. An axial flow inducer for hydraulic devices according to claims 1 wherein the inducer comprises at least two stages of axial flow blades including a front stage axial flow blade part located at the fluid inlet side and a rear stage axial flow blade part, the outer diameter of said rear stage axial flow blade part being smaller than the outer diameter of said front stage axial flow part, and said sleeve is secured to the edge of the foremost blade of the front stage.

5. An axial flow inducer for hydraulic devices as claimed in claim 4, wherein a gap between the outer peripheral edge of said front stage axial flow blade part and the inside wall surface of the inlet of said pump chamber is confined as small as possible.

6. An axial flow inducer for hydraulic devices as claimed in claim 4, wherein said front stage axial flow blade part is detachably connected to the rear stage axial flow blade part.

7. An axial flow inducer for hydraulic devices as claimed in claim 4, wherein a difference between the outer diameter $D_1$ of said front stage axial flow blade part and the outer diameter $D_2$ of said rear stage axial flow blade part is defined by a formula given by $D_1-D_2=(0.03 \text{ to } 0.1)D_1$.

* * * * *